US006338210B1

(12) United States Patent
Mele

(10) Patent No.: US 6,338,210 B1
(45) Date of Patent: Jan. 15, 2002

(54) APPARATUS AND METHOD FOR REMOVING ACCUMULATED DEPOSITS OF SNOW

(76) Inventor: Peter C. Mele, P.O. Box 533, Crown Pt, NY (US) 12928

( * ) Notice: Subject to any disclaimer, the term of this patent is extended or adjusted under 35 U.S.C. 154(b) by 0 days.

(21) Appl. No.: 09/377,929

(22) Filed: Aug. 20, 1999

Related U.S. Application Data

(63) Continuation-in-part of application No. 08/837,911, filed on Apr. 11, 1997, now abandoned.

(51) Int. Cl.[7] ..... E01H 5/02
(52) U.S. Cl. ..... 37/285; 294/54.5
(58) Field of Search ..... 294/49, 51, 53.5, 294/54.5, 55–57, 59; 37/241, 265, 266, 268, 270, 284, 285, 434; 56/400.01, 400.04, 400.13

(56) References Cited

U.S. PATENT DOCUMENTS

| | | | | | |
|---|---|---|---|---|---|
| 2,772,490 | A | * | 12/1956 | Hnastchenko | 294/59 X |
| 3,218,738 | A | * | 11/1965 | Bowerman | 294/54.5 X |
| 3,343,807 | A | * | 9/1967 | Moraski | 294/54.5 X |
| 3,483,643 | A | * | 12/1969 | Wenzel | 294/54.5 X |
| 4,214,385 | A | * | 7/1980 | Baranowski et al. | 294/54.5 X |
| 4,249,767 | A | * | 2/1981 | Andreasen | 294/54.5 X |
| D360,342 | S | * | 7/1995 | Shea | 294/54.5 X |
| 5,465,510 | A | * | 11/1995 | Goodnough et al. | 294/54.5 X |
| 5,524,369 | A | * | 6/1996 | Phillips | 294/54.5 X |

* cited by examiner

*Primary Examiner*—Johnny D. Cherry
(74) *Attorney, Agent, or Firm*—George E. Kersey

(57) ABSTRACT

Apparatus for the removal of accumulated material, such as snow, by an elongated control member attached to the edge of a curved scoop, with a strut mechanism extending from the elongated control member to the curved scoop and attached to a mechanism for facilitating the movement of the curved scoop over a surface having accumulated material.

15 Claims, 6 Drawing Sheets

APPARATUS AND METHOD FOR REMOVING ACCUMULATED DEPOSITS OF SNOW

This is a continuation-in-part of Ser. No. 08/837,911, filed Apr. 11, 1997 now abandoned. The invention relates to the removal of accumulated materials, such as accumulations of snow, ice and surface debris, and more particularly to the removal of accumulated debris, including snow and ice, by "rakes" which can be operated in respective "pull" and "push" modes.

When there is excessive accumulation of material, such as snow and ice on the roof of a building, structural damage may result unless the accumulated ice and snow are removed promptly. When there is an excessive accumulation of material on a surface in general, that accumulation may pose a hazard.

For the removal of accumulated debris, a number of implements have been designed which can be designated as "debris rakes", and, in the case of roofs, are commonly designated as "roof rakes".

Ordinarily these rakes are of the "pull" type which require that they be lifted over the accumulated debris, such as snow and ice, that are to be pulled away, for example, from a roof. A consequence of the need to elevate the rake at the conclusion of each pull stroke, to position it for a further pull stroke, is that physical exertion is required.

This can have adverse consequences when the material to be removed is in an awkward location, such as on a roof. The result often is the occurrence of physical injuries, particularly to the back.

Accordingly, it is an object of the invention to facilitate the removal of accumulated material, such as snow and ice, from relatively inaccessible locations, such as roof tops.

Accumulated materials, such as ice and snow, can impose a relatively heavy burden on the implement by which they are to be removed. In the face of freezing and thawing conditions, accumulated snow and ice can strongly adhere to an underlying surface, with the result that the pulling operation often leads to damage to the implement, because the force of resistance can exceed the material strength of the implement. Consequently, a further object of the invention is to provide a removal implement that is constructed for durability in the presence of difficult-to-remove materials.

Another object of the invention is to provide a removal implement which is easy to use with an economical mechanical advantage so that the user will not be unduly fatigued. A related object is to provide an implement by which accumulated materials, such as ice and snow, can be sheared from their position of accumulation.

A further object of the invention is to reduce the amount of time and energy that need to be expended in the removal of a prescribed amount of accumulated material, such as ice and snow, from a location such as a roof.

SUMMARY OF THE INVENTION

In accomplishing the foregoing and related objects the invention provides for the removal of accumulated materials, such as ice and snow, using an elongated control member attached to a scoop, which can be curved or semi-curved by having at least one bend from near of the scoop extending to a slanted section which lifts the debris. The lower edge of the scoop is nearly parallel to the surface of the debris.

In accordance with one aspect of the invention, the scoop is attached at a first location to the control member, and a strut mechanism is positioned against the control member at a second location, displaced from the first location. The scoop attached to the control member can also be connected to a member for facilitating the movement of the scoop over a surface having the accumulated material.

In accordance with another aspect of the invention, the strut mechanism is formed by oppositely positioned arms contacting the control member. The flexible scoop has an edge flange integral with or connected to the control member at the first location, and the strut mechanism has oppositely positioned and separated legs extending from respective ones of the arms and connected to the scoop, which is flexible to the extent that the leading edge angle can be adjusted by altering the strut position on the control member, which can be tubular.

Where there is a facilitating member, it is a rotational member attached to the scoop, which has a lower edge displaced from the elongated control member, and the rotational member is attached to the lower edge. A plurality of rotational members can be attached to the lower edge and take the form of wheels.

Each wheel can be attached to the curved scoop by a shaft extending therefrom to an axle for the wheel. A strut mechanism can extend from the elongated control member to the curved scoop with the facilitating member, which can be rotational, attached thereto.

The strut mechanism can have oppositely positioned arms contacting the control member, and rotational members can be connected at the base of the scoop, for example, to the arms or feet of the strut mechanism.

In accordance with a further aspect of the invention, the legs extend to the scoop and are connected directly to the scoop, or by feet which are connected to the scoop to lie flush therealong. The strut mechanism can include a collar by which the arms are retained against the control member. In addition, the arms can be connected together above the control member.

In accordance with a further aspect of the invention, an extension member can be connected to the control member. A plurality of such extension members can be connected to the control member at either end, or at opposite ends, thereof.

In apparatus for the removal of accumulated material, the control member can be an elongated tube attached to a scoop by a tube clamp which arcuately contacts the elongated tube and is connected to a flange portion of the scoop. The strut mechanism can be formed by a plurality of members, each including a foot, a leg and an arm, with each arm positioned against the elongated tube at a location displaced from the tube clamp, and each foot can be secured to the flexible scoop.

In a method of fabricating apparatus for removal of accumulated materials, the steps include (a) providing a control member and a curved scoop; (b) attaching the control member to the scoop; and (c) positioning a strut mechanism against the control member and attaching the strut mechanism to the scoop. The method can further include the step of providing the flexible scoop with an elongated flange and attaching the control member to the elongated flange.

A member can be attached for facilitating the movement of the scoop over a surface having the accumulated material. A rotational member, such as a wheel, can be attached to the scoop for facilitating the movement thereof.

The strut mechanism can have separated feet to which the facilitating member is attached. The method can also include the step of providing the strut mechanism with separated feet and attaching the separated feet to the flexible scoop. In addition, extension members can be attached to the control member.

In a method of removing accumulated material from a deposit position, the steps include (a) positioning a curved scoop near the accumulated material; (b) moving the scoop over the accumulated material by sliding or moving at an elevated position and (c) moving the scoop against the accumulated material. This can be without engaging a surface on which the accumulated material has been deposited. A controlled rotation can be imparted to the scoop to steer it to a prescribed location. The scoop is moved at an elevated position by a member, which can be rotational, engaging the surface. The scoop can be retracted, in the pull mode, against the accumulated material to move it from its deposit position.

The method further includes the steps of (a) positioning a scoop, suspended from a control member, at the edge of a roof near accumulated moisture in frozen condition; and (b) rolling the scoop over the accumulated moisture in frozen condition. The scoop is then rolled against the accumulated moisture in frozen condition.

The control member can be supplemented by an extension that allows a pulling action parallel to the surface of the roof.

The removal method can also include the step of moving the control member with the suspended scoop over the frozen moisture by rotating the control member to steer the scoop to a prescribed location for removal of the frozen moisture. Removal of the frozen moisture is by pulling the control member with the scoop suspended in a direction parallel to the roof surface.

Other features of the invention include the presence of an approximately horizontal, i.e. surface parallel, scraping edge on the scoop; the provision of flat struts for attachment to the scoop in order to maintain directional stability during travel; and extension of a control pole beyond the top of the scoop in order to allow the attachment of a push-pole, which can be inserted using a push plug socket similar to that found in vacuum cleaner connected tubing.

DESCRIPTION OF THE DRAWINGS

Other aspects of the invention will become apparent after considering several illustrative embodiments, taken in conjunction with the drawings in which.

DETAILED DESCRIPTION

Figure 1:
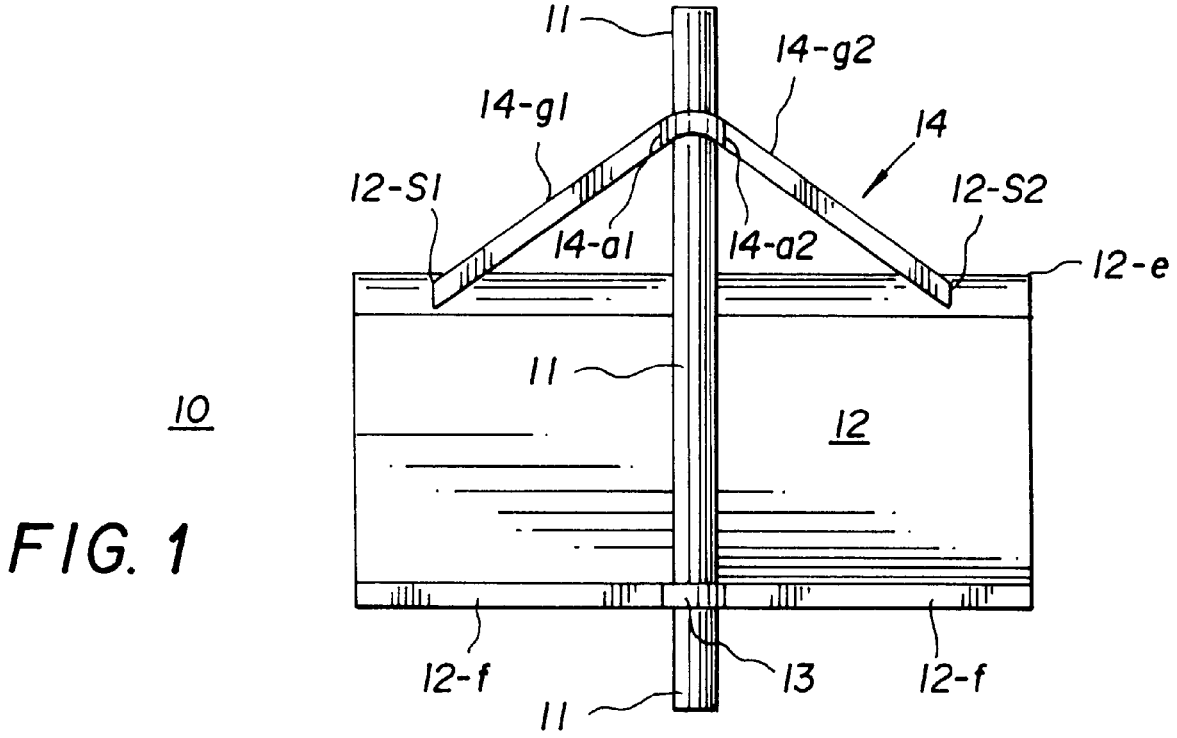
FIG. 1 is a plan view, as seen from above, of a push-pull snow rake in accordance with the invention, whereby snow or other material may be removed from the surface of a roof.

With reference to the drawings, a push-pull snow rake 10 of the invention, in FIG. 1 is seen in plan view from above, formed by an elongated control member 11, illustratively a tube, to which a curved scoop 12 is connected by a clamp 13 at a flange 12-*f* forming one edge of the scoop 12. The opposite edge 12-*e* of the scoop 12 is connected at separated positions 12-*s*1 and 12-*s*2 to legs 14-*g*1 and 14-*g*2 of a strut 14. The legs 14-*g*1 and 14-*g*2 converge at arms 14-*a*1 and 14-*a*2 which are in arcuate contact with the tube 11, and may be screwed into the tube 11. It is to be noted that for the embodiment of FIG. 1, the edge 12-*e* of the scoop 12 is a reinforcement that is integral with the legs 14-*g*1 and 14-*g*2.

The scoop is curved so that it acts like the tip of a ski. It rides up over snow going upward (in either the pull or push mode). It turns by bearing on one or other curved edge.

Flexibility can be provided to the scoop by moving the struts to allow a change of angle of attack. Alternatively, this can be locked out.

The plane of the struts desirably is parallel to the direction of motion of the scoop, so that the struts can act like rudders in the snow. With an ordinary snow rake, when dense snow is encountered on one side, the rake tends to veer away from the desired direction. With the bladed struts of the invention, this bending away is counteracted by the action of the strut in turning towards the denser snow. As a result, the scoop of the invention is self-correcting in the presence of variable-density snow. The struts stop side slipping and also guide the rake when pull is diagonally down the slope of a roof, as opposed to being straight down, when necessitated by the presence of shrubs or other impediments.

For the push mode of operation in accordance with the invention, the scoop is desirably used on fairly flat surfaces, such as roofs and decks, but it may be used on other surfaces as well. The push mode can keep users from getting near roof edges and encountering falling snow, as would be the case for operation in the pull mode.

When the leading edge of the scoop is parallel to the roof, it clears and cuts snow from the roof, rather than push it down. In addition, there are glides and spacers under the leading edge to guard against having the scoop hit roof screws and nails. This also spaces the scoop above solid ice, by which scoop contact could damage the roof.

Figure 2:
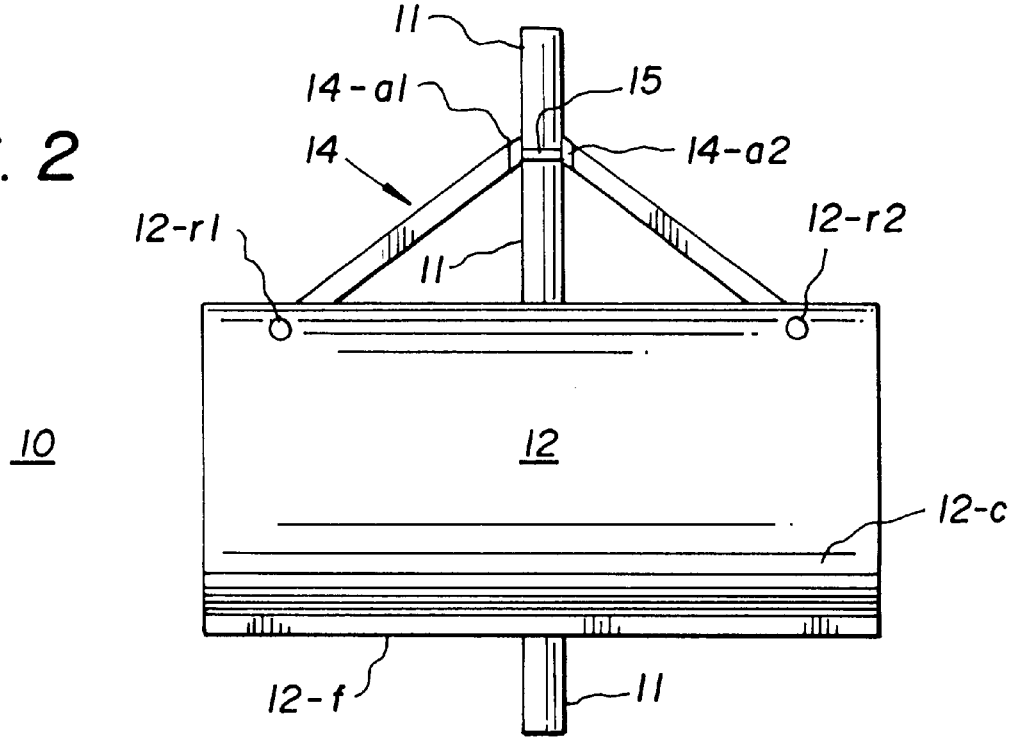
FIG. 2 is a bottom view of the push-pull snow rake of FIG. 1, with the snow rake upside down.

As viewed in FIG. 2 from the bottom of the rake 10, the edge 12-*e* with the integral arms 14-*g*1 and 14-*g*2 is secured to the scoop 12 by a spacer 12-*r*1 and a glide 12-*r*2. Also as indicated in FIG. 2, the flange 12-*f* represents a flat extension from the curvature 12-*c* of the scoop 12. In addition, the arms 14-*a*1 and 14-*a*2 are joined together by a connector 15 which can permit the control tube 11 to move slideably in relation to the strut mechanism 14 before being fully tightened.

Figure 3:
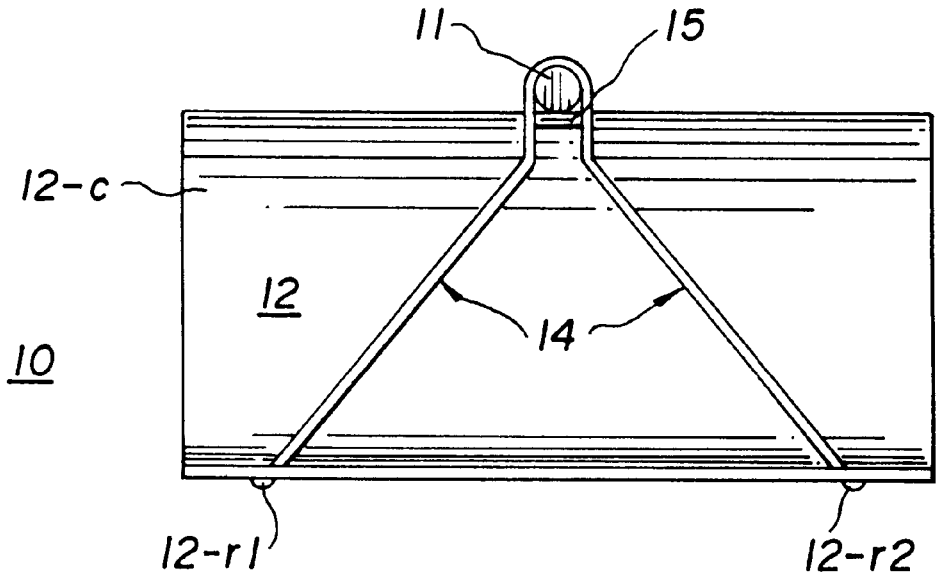
FIG. 3 is a front view, as seen when the user is placing the push-pull snow rake of FIG. 1 in position for snow removal.

The arrangement of the scoop 12 through the strut 14 in relation to the tube 11 is further illustrated in FIG. 3, which is a front view of the push-pull rake 10, as seen when the user is placing the rake of FIG. 1 in position for snow removal. The members 14-*g*1 and 14-*g*2 of the strut 14 are fixed in position on the control tube 11 when the connector 15 is fully tightened.

Figure 4:
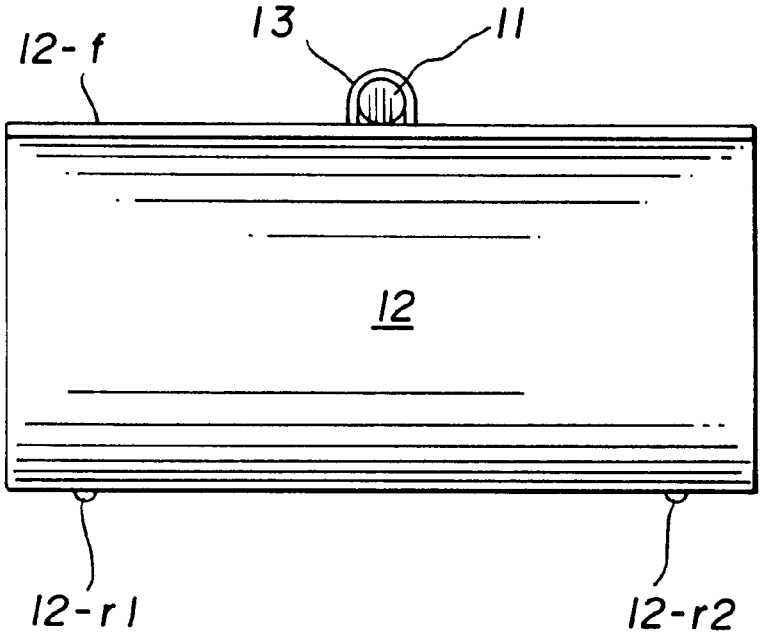
FIG. 4 is a back view of the push-pull snow rake of FIG. 1, opposite the front view of FIG. 3.

The arrangement of the scoop 12 to the clamp 13, in relation to the tube 11, is illustrated in FIG. 4, which is a back view of the push-pull snow rake of FIG. 1, opposite the front view of FIG. 3. Although the strut 14 is movably mounted on the control tube 11 by the connector 15 in FIG. 3, the clamp 13 in FIG. 4 is fixed to the control tube 11. But either or both strut and clamp may be movably mounted.

Figure 5:
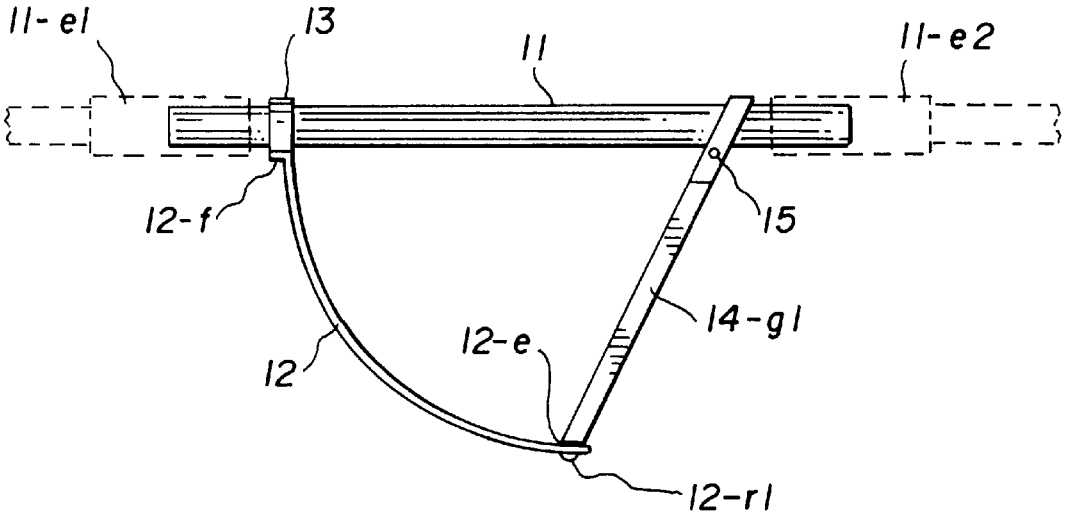
FIG. 5 is a side elevation view of the snow rake of FIG. 1, with dashed lines indicating the positioning of auxiliary push and pull extensions.
Figure 6:
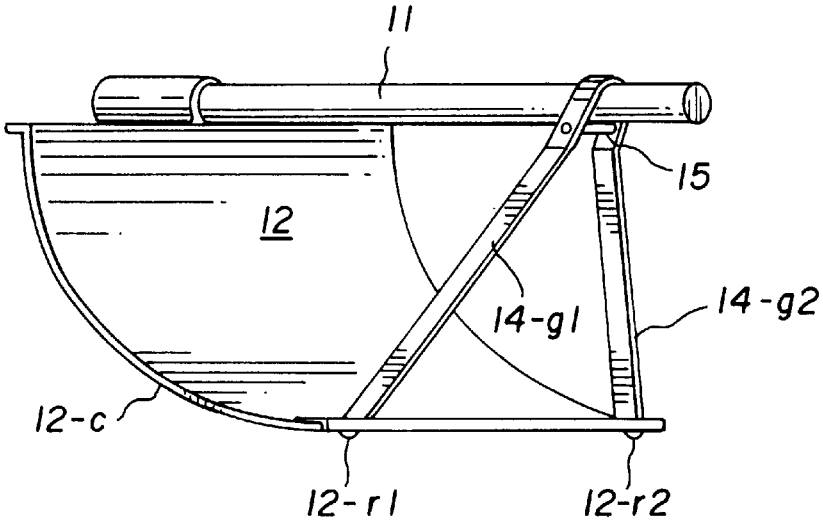
FIG. 6 is a perspective view of the push-pull snow rake of FIG. 1.

In FIG. 5, which is a side elevation view of the snow rake 10 of FIG. 1, dashed lines indicate the positioning of auxiliary push and pull extensions 11-*e*l and 11-*e*2. The secure connection of the pole 11 to the clamp 13 and the flange 12-*f* of the scoop 12 is by any convenient fashion, so that the motion of the sheet metal scoop 12 is anchored in relation to the movable strut 14. These details are shown in perspective view in FIG. 6.

Figure 7:
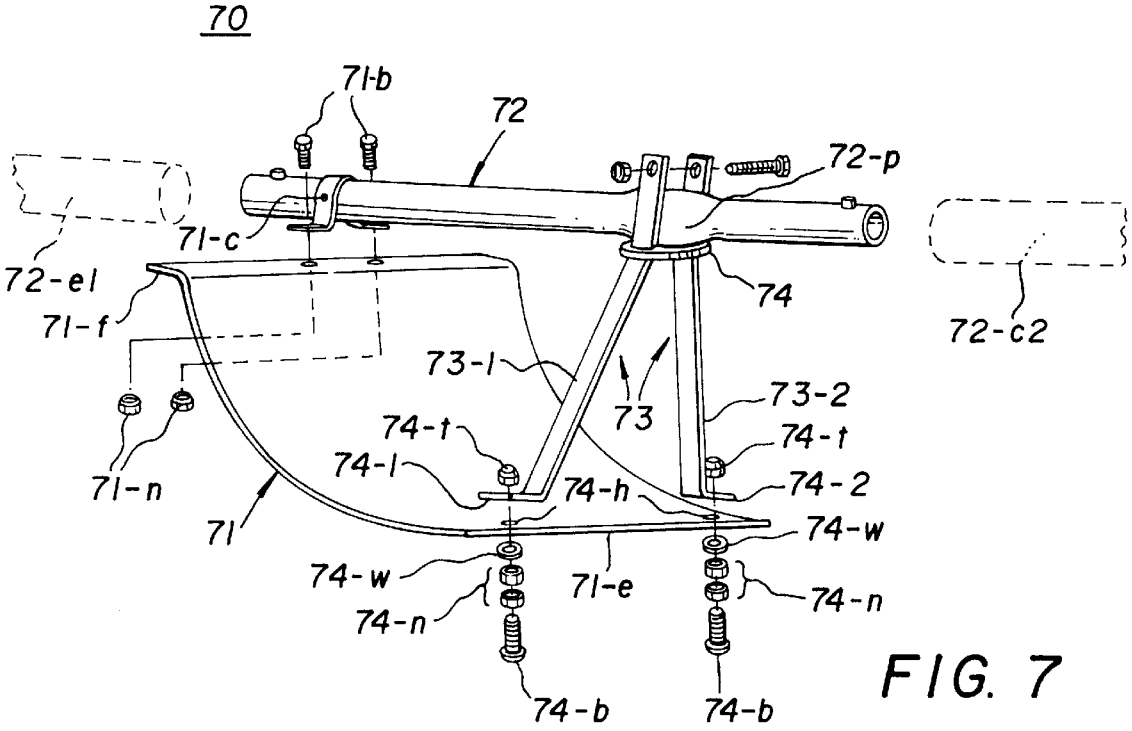
FIG. 7 is an exploded view of an alternative embodiment of the invention showing the inter-relation of structural components and auxiliary extensions.

In the alternative embodiment 70 shown in FIG. 7, the rake is assembled by attaching a tube clamp 71-*c* to the flange 71-*f* of the scoop 71 using, for example, bolts 71-*b* and lock nuts 71-*n*. A collar 74 is positioned by sliding over struts 73-1 and 73-2, with flat parts on the inside of the collar 74 resting on the struts 73-1 and 73-2, which are then positioned about indented portions 72-*p* on opposite sides of the control tube 72. A connector 75 is inserted through holes 75-*h*1 and 75-*h*2 and tightened by lock nut 75-*n*.

The feet 74-1 and 74-2 of the strut 73 are to lie flush near the scoop edge 71-*e* and are illustratively attached using spacer bolts 74-*b* and nuts 74-*n*. Although in FIG. 7 the nuts 74-*n* are used as spacers, other arrangements are possible, such as a single nut locked against the bottom of the scoop 71.

The strut feet 74-*f* are centered about holes 74-*h* in the scoop 71. For maximum height the feet are used with a plurality of standard nuts 74-*n*, a washer 74-*w*, and a lock nut 74-*t*, joined to bolts 74-*b* to hold the feet in place. For other heights, one or both of the standard nuts 74-*n* can be removed, but the washer 74-*w* desirably is used.

Figure 8:
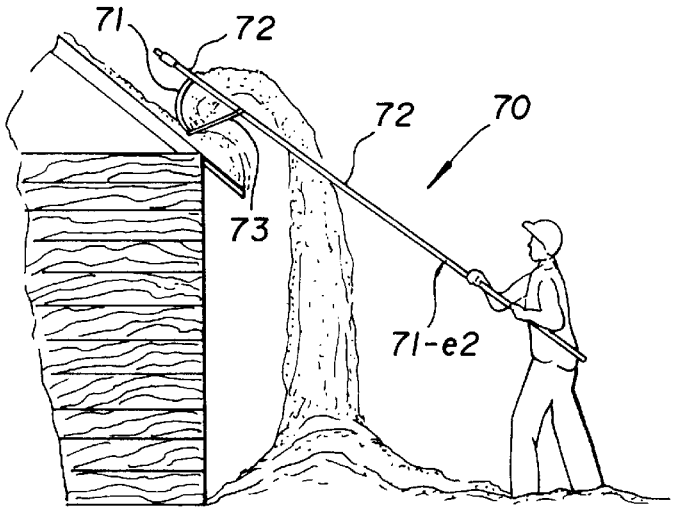
FIG. 8 is a view of the push-pull snow rake of FIG. 7 being used to remove snow from a roof in accordance with the invention.
Figure 10:
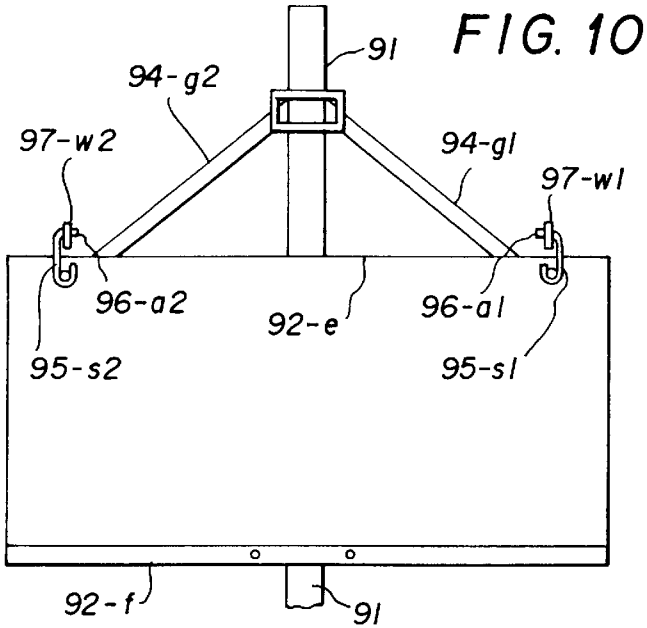
FIG. 10 is a bottom view of the snow rake of FIG. 9, with the snow rake upside down.
Figure 12:
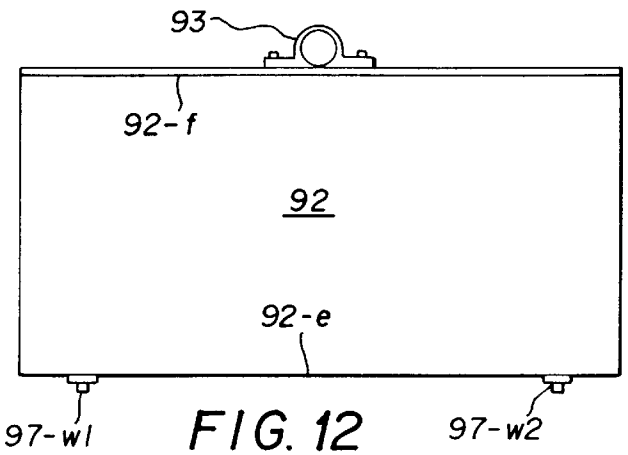
FIG. 12 is a back view of the snow rake of FIG. 9, opposite the front view of FIG. 11.

In operation of the snow rake 70, as illustrated in FIG. 8, a sufficient number of extension poles is attached to the rake to position it at the edge of a roof, depending on the height of the roof and avoiding electrical wiring as the rake is lifted to the edge of the snow.

With the rake resting on the roof edge, an appropriate number of poles is added for the height of the roof to allow a pull parallel to the surface of the roof. The rake is then pushed or pulled up over the snow rotating the handle slightly to the left or the right to steer, and the snow is removed by pulling parallel with the roof surface.

The scoops 12 and 71 desirably are concave-convex, with a concave interior and a convex exterior, formed of sheet material, such as plastic or aluminum, which can be strengthened at the upper margin by a folded or rolled portion 12-*f*, and provided with a lower margin edge, which can be reinforced and can be used in shearing. The connections to a scoop may be by riveting, and the front edge can be tapered or sharpened.

The curved scoops 12 and 71 are curved in an arc which can be adjusted by movement of the control poles 11 and 72 at their strut positions, or at the clamps 13 and 71-*c*.

Figure 9:
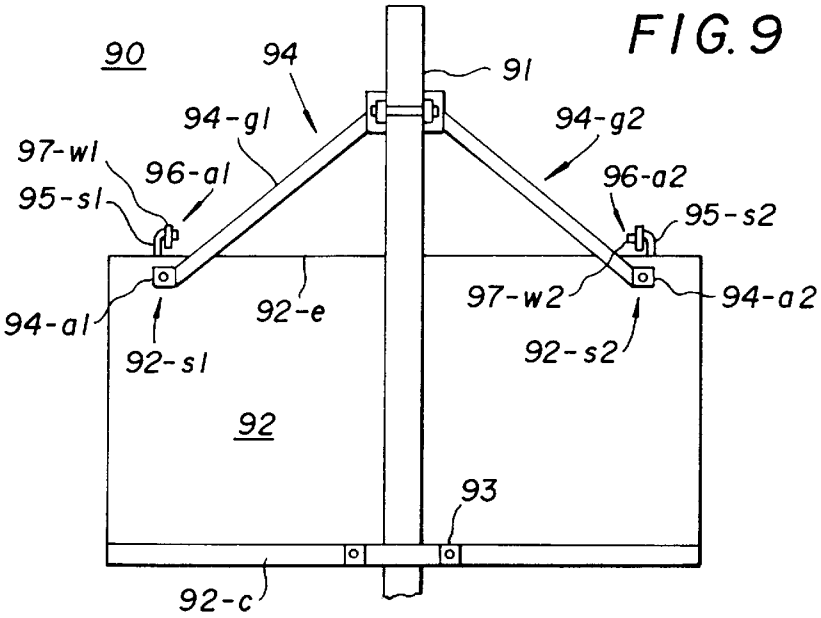
FIG. 9 is a plan view, as seen from above, of a snow rake in accordance with the invention, whereby snow or other material may be removed from the surface of a roof.
Figure 11:
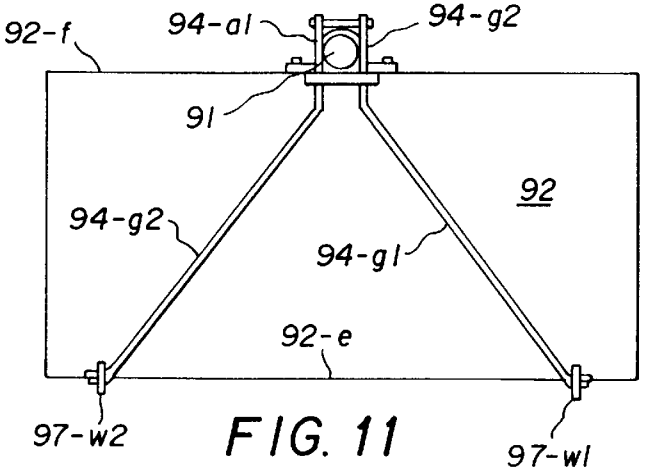
FIG. 11 is a front view, as seen when the user is placing the snow rake of FIG. 9 in position for snow removal.

With further reference to the drawings, a snow rake 90 of the invention, in FIG. 9 is seen in plan view from above, formed by an elongated control member 91, illustratively a tube, to which a curved scoop 92 is connected by a clamp 93 at a flange 92-*f* forming one edge of the scoop 92. The opposite edge 92-*e* of the scoop 92 is connected at separated positions 92-*s*1 and 92-*s*2 to legs 94-*g*1 and 94-*q*2 of a strut 94. The legs 94-*g*1 and 94-*g*2 converge at arms 94-*a*1 and 94-*a*2 which are in arcuate contact with the tube 91. The arms may be screwed into the tube 91, which can be bent in a vertical plane containing the tube 91 in order to provide a curved angle of attack for the debris, so that the leading edge can be nearly perpendicular to the surface containing the debris. The tube 91 may be upwardly curved beyond the scoop 92 and downwardly curved before the scoop 92. It is to be noted that for the embodiment of FIG. 9, the edge 92-*e* of the scoop 92 is a reinforcement that is integral with the legs 94-*g*1 and 94-*g*2.

Extending from the separated positions 92-*s*1 and 92-*s*2 are shafts 95-*s*1 and 95-*s*2 which terminate in axles 96-*a*1 and 96-*a*2 for rotational members taking the form of wheels 97-*w*1 and 97-*w*2.

The scoop is substantially curved so that it acts like the tip of a ski and can have one or more bends from a nearly horizontal leading edge.

The scoop rides up over snow going upward. It turns by bearing on one or other curved edge. Flexibility can be provided to the scoop by moving the struts to allow a change of angle of attack.

The plane of the struts desirably is parallel to the direction of motion of the scoop, so that the struts can act like rudders in the snow. With an ordinary snow rake, when dense snow is encountered on one side, the rake tends to veer away from the desired direction. With the bladed struts of the invention, this bending away is counteracted by the action of the strut in turning towards the denser snow. As a result, the scoop of the invention is self-correcting in the presence of variable-density snow. The struts stop side slipping and also guide the rake when pull is diagonally down the slope of a roof, as opposed to being straight down, when necessitated by the presence of shrubs or other impediments.

Because the wheels 97-*w*1 and 97-*w*2 are near or under the leading edge, the scoop is guarded against hitting roof screws and nails. The wheels 97-*w*1 and 97-*w*2 may be mounted above the scoop as long as they protrude below it. This also spaces the scoop above solid ice, by which scoop contact could damage the roof. The wheels 97-*w*1 and 97-*w*2 also protect the roof surface from abrasion and reduce friction of the rake with respect to the roof surface during each snow removal stroke.

Figure 13:
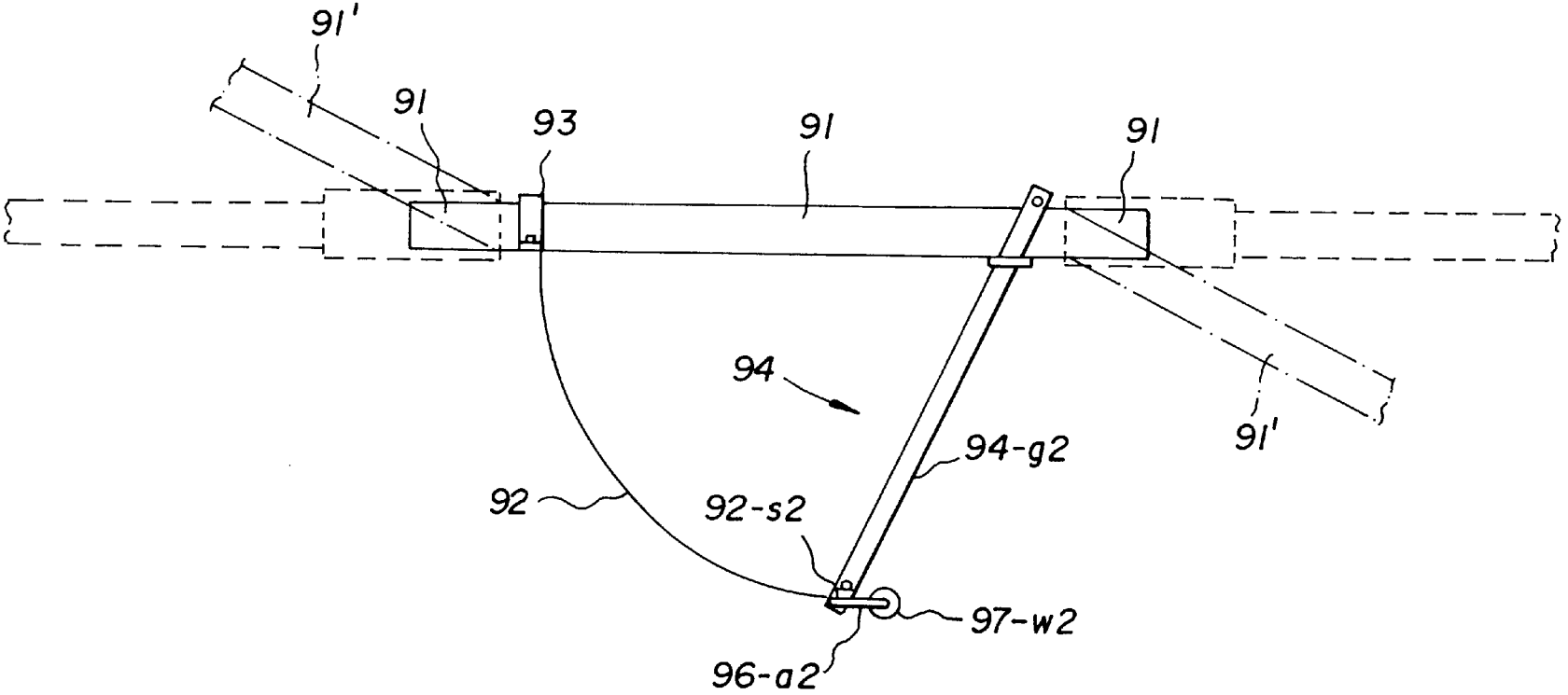
FIG. 13 is a side elevation view of the snow rake of FIG. 9, with dashed lines indicating the positioning of auxiliary push and pull extensions.

Also illustrated in FIG. 13 by phantom segments 91' is the alternative extension of the tube 91 and the bending of the extensions 91' in a vertical plane containing the tube 91 in order to better maintain an angle of attack of the leading edge to shear away the debris, such as snow from a roof. As indicated in FIG. 13 the tube 91 is upwardly curved in an extension 91' beyond the clamp 93 of the scoop 92 and downwardly curved in an extension 91' before the strut 94 of the scoop 92.

It will be understood that the foregoing detailed description is illustrative only and that other implementations and uses of the invention will be apparent to those of ordinary skill in the art.

What is claimed is:

1. Apparatus for the removal of accumulated material comprising an elongated control member;

a curved scoop having an edge attached to said control member; and means for facilitating the movement of said curved scoop over a surface having said accumulated material;

wherein a strut mechanism extends from said elongated control member to said curved scoop and the facilitating means is attached thereto.

2. Apparatus as defined in claim 1 wherein the facilitating means comprises a rotational member attached to said scoop.

3. Apparatus as defined in claim 2 wherein said scoop has a lower edge displaced from said elongated control member and said rotational member is attached to said lower edge.

4. Apparatus as defined in claim 3 wherein a plurality of rotational members are attached at said lower edge.

5. Apparatus as defined in claim 2 wherein said rotational member comprises a wheel.

6. Apparatus as defined in claim 5 wherein said wheel is attached to said scoop by a shaft extending therefrom to an axle for said wheel.

7. Apparatus as defined in claim 1 wherein the facilitating means comprises said strut mechanism positioned against said control member at a location displaced from the attachment of said scoop to said control member; and means for attaching said strut mechanism to said scoop.

8. Apparatus as defined in claim 7 wherein said strut mechanism comprises oppositely positioned arms contacting said control member.

9. Apparatus as defined in claim 7 wherein said strut mechanism comprises oppositely positioned arms contacting said control member and rotational members are connected to said arms.

10. Apparatus as defined in claim 1 wherein said scoop has a curvature which extends laterally in relation to said control member perpendicular to the direction of elongation of said control member.

11. Apparatus as defined in claim 1 further including an extension member connected to said control member.

12. Apparatus as defined in claim 11 wherein a wheel is attached to said curved scoop for facilitating the movement thereof.

13. Apparatus as defined in claim 1 for the removal of accumulated material wherein said control member is an elongated tube;

said control member is attached to said curved scoop by a tube clamp which arcuately contacts said elongated tube and is connected to a flange portion of said scoop;

said strut mechanism comprises a plurality of members each including a foot, a leg and an arm with each arm positioned against said elongated tube at a location displaced from said tube clamp and each foot secured to said scoop.

14. A method for removing accumulated material which comprises the steps of (a) providing a curved scoop with a control member attached to said scoop overlying the curvature thereof; and (b) moving said curved scoop over a surface having said accumulated material by a strut mechanism having separated feet attached to said scoop with means positioned beyond and under a leading edge of said scoop for facilitating the movement of said scoop;

thereby to guard against hitting roof screws and nails.

15. The method of claim 14 further including the step of sliding said strut mechanism against said control member and attaching said strut mechanism to said scoop.

* * * * *